United States Patent [19]

Yamazaki et al.

[11] Patent Number: 4,887,000

[45] Date of Patent: Dec. 12, 1989

[54] ELECTRON BEAM GENERATION APPARATUS

[75] Inventors: Fumio Yamazaki, Hirakata; Toshifumi Nakatani, Moriguchi, both of Japan

[73] Assignee: Sushita Electric Industrial Co., Ltd., Kadoma, Japan

[21] Appl. No.: 116,848

[22] Filed: Nov. 5, 1987

[30] Foreign Application Priority Data

Nov. 6, 1986 [JP] Japan ..... 61-265104
Nov. 6, 1986 [JP] Japan ..... 61-265105
Nov. 11, 1986 [JP] Japan ..... 61-269422

[51] Int. Cl.[4] ..... H01J 63/02; H01J 19/12

[52] U.S. Cl. ..... 313/422; 313/269; 313/495

[58] Field of Search ..... 313/422, 495, 269

[56] References Cited

U.S. PATENT DOCUMENTS 3,783,327 1/1974 Adams, Jr. ..... 313/269 X

*Primary Examiner*—Palmer C. DeMeo

*Attorney, Agent, or Firm*—Cushman, Darby & Cushman

[57] ABSTRACT

In an electron beam generation apparatus for a flat cathode ray tube, line cathodes are stretched in an arc shaped form and held by plural cathode position defining members. The cathode position defining members are disposed along the line cathode in a forward convex arc which protrudes most at its center and less towards its respective ends. An electron beam take-out electrode is placed at a in front side of the line cathode and a back electrode is placed at a back side of said line cathode, the electron beam take-out electrode and back electrode also being arc shaped.

11 Claims, 9 Drawing Sheets

ELECTRON BEAM GENERATION APPARATUS

FIELD OF THE INVENTION AND RELATED ART STATEMENT

1. FIELD OF THE INVENTION

The present invention relates to an electron beam generation apparatus, and more particularly, the present invention relates to an electron beam generation apparatus suitable for use with line cathodes of a flat type cathode ray tube.

2. DESCRIPTION OF THE RELATED ART

Electron beam generation apparatus for flat cathode ray tubes are being developed for use in television receivers, computer terminal display apparatuses, or other flat shape display apparatuses. Hitherto, an electron beam generation apparatus for such flat cathode ray tubes has been configured as shown in FIG. 13, for example. In the configuration of FIG. 13, line-shaped cathodes 17*a*, 17*b*, . . . are stretched between a pair of holders $\mathbf{19}_1$ and $\mathbf{19}_2$, which are provided with a predetermined distances therebetween and an appropriate tension. In the known flat-shaped cathode ray tube, a back electrode 10 and electron beam take-out electrode 13*a* having many electron passing apertures 12 are provided with parallel rows of the line-shaped cathodes 17*a*, 17*b*, therebetween. Such rows of the line-shaped cathodes 17*a*, 17*b*, . . . are provided in a direction perpendicular to the sheet of FIG. 13.

The above-mentioned conventional electron beam generation apparatus operates by impressing an appropriate potential upon the electron beam take-out electrode 13*a*, whereby thermo-electrons emitted from the line-shaped cathode 10 which are heated by current therethrough are taken-out to form beams which are emitted forwards through the electron passing apertures 12.

The above-mentioned configuration has been applied in the conventional flat type cathode ray tube as shown in FIG. 14 in a horizontal sectional view and in FIG. 14 which is a vertical sectional view taken by Z—Z sectional plane of FIG. 15. In FIG. 14 and FIG. 15, in a vacuum casing 4 consisting of a face plate 1, side plates and back plate 3, an electron beam generation apparatus 5 is contained. The electron beam generation apparatus 5 comprises from the front side to the back side horizontal deflection electrodes $\mathbf{6}_1$, $\mathbf{6}_2$, . . . , $\mathbf{6}_7$, electron beam take-out electrodes 11, a row of vertical line-shaped cathodes 9*a*, 9*b*, . . . , 9*f* and a back electrode 10. A phosphor screen 7 is provided on the inner wall of the face plate 1. Insulative supporting pins 8 are also provided so as to project from respective horizontal deflection electrodes $\mathbf{6}_1$, $\mathbf{6}_2$, . . . , $\mathbf{6}_7$ to touch the inside wall of the face plate 1. When the inside space of the vacuum casing 4 is evacuated, the back plate 3 is stressed towards the face plate 1 by means of large atmospheric pressure between the face plate 1 and the back plate 3, and the pressing force of the back plate 3 is supported by the touchings of the supporting pins 8 on the inside face of the face plate 1. In addition, the electron beam take-out electrodes 11 comprise plural electrodes 13*a*, 13*b* and 13*c* respectively having beam passing apertures 12 and which are isolated with insulation spacers 14 therebetween. As shown in FIG. 15, the line-shaped cathodes 9*a*, 9*b*, . . . , 9*f* are given appropriate tension by wire strings 15*a* and 15*b*. The electron beam take-out electrodes 11 are held on the back electrode 10 with insulation spacers 16 therebetween.

During operation with electron beams radiated from the line cathodes 9*a*, 9*b*, . . . , 9*f* are taken out forwards through apertures 12 of the electron beam take-out electrodes 11 and deflected by the horizontal electrodes $\mathbf{6}_1$, $\mathbf{6}_2$, . . . , $\mathbf{6}_7$ to strike the phosphor screen 7, thereby to emit light.

In the conventional configuration as shown in FIG. 13 through FIG. 15, when the lengths of the line-shaped cathode electrodes 17*a*, 17*b*, . . . or 9*a*, 9*b*, . . . are of certain lengths, the line cathodes vibrate due to small mechanical shock or small electric field interaction, thereby making simple harmonic chordal motion. When the chordal harmonic motion occurs, the emission current from each cathode changes, and therefore, fluctuation of brightness on the display screen of the TV or computer display occurs. Furthermore, when the cathodes making the chordal harmonic motion touch the electron beam take-out electrodes 13*a* of FIG. 13 or 11 of FIG. 14, a large short-circuit current flows through the cathode electrodes 17*a*, 17*b*, . . . or 9*a*, 9*b*, . . . , and the line cathodes break.

In order to improve the above-mentioned shortcomings, an improvement has been made as shown in FIG. 16, whereby several protrusions $\mathbf{105}_1$, $\mathbf{105}_2$ and $\mathbf{105}_3$ are provided on the back electrode 10 so as to touch the line-shaped cathode, thereby to suppress the simple harmonic chordal motion. However, it is difficult to make the heights $\mathbf{1}_1$, $\mathbf{1}_2$ and $\mathbf{1}_3$ of the protrusions $\mathbf{105}_1$, $\mathbf{105}_2$ and $\mathbf{105}_3$ uniform so as to touch the line-shaped cathode 17*a*, 17*b*, . . . uniformly. Accordingly, the suppression of the simple harmonic motion cannot be attained sufficiently.

OBJECT AND SUMMARY OF THE INVENTION

The purpose of the present invention is to provide an improved electron beam generation apparatus which is capable of displaying a stable picture without causing the undesirable effect due to simple harmonic chordal motion of the line-shaped cathodes.

The electron beam generation apparatus in accordance with the present invention comprises:

- at least one line cathode stretched between a pair of holding means for holding the at least one line cathode at both ends thereof,
- an electron beam take-out electrode means provided on a front side of the at least one line cathode with a predetermined gap therefrom,
- a back electrode provided on a back side of the at least one line cathode with a predetermined gap therefrom, and
- plural cathode position defining means disposed at predetermined positions along the at least one line cathode to shape it into a forward convex arc which protrudes at its center toward the electron beam take-out electrode.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

In FIG. 3 and FIG. 4, the front and back direction of the flat type cathode ray tube is shown prolonged for easy illustration.

In FIG. 14 and FIG. 15, the front and back direction of the flat type cathode ray tube is shown prolonged for easy illustration.

DETAILED DESCRIPTION OF THE PREFERRED EMBODIMENT

In the electron beam generation apparatus in accordance with the present invention, line-shaped cathodes are stretched in a parallel row between a back electrode and an electron beam take-out electrode having many electron beam passing apertures in an evacuated casing. The back electrode is bent by atmospheric pressure toward the face plate so that supporting members are pressed onto the inner wall of the face plate 1, and each line-shaped cathode is held by a plural cathode position defining member, such as a cathode vibration stopper, which is provided along the cathode at certain intervals and disposed to form an arc shape by the bending of the back plate 10. Holding members which are formed as bars which are thin at the center and thick at each end are provided on a forward side of the electron beam take-out electrode so that the supporting members flatly abut the inner wall of the face plate.

According to the constitution of the present invention, by means of plural position defining means disposed at predetermined positions along the line cathodes so as to shape it in a forward convex manner to protrude toward the electron beam take-out electrode most at its center and less at its respective ends, the line-shaped cathode electrodes are stretched into an arc shaped form which is forward convex. Therefore, all of the position defining means certainly contact the line-shaped cathode thereby to form contact points at nodes of vibration of the line-shaped cathodes, and hence the frequency of natural vibration becomes high and the amplitude of vibration becomes small such that attenuation of vibration of the line-shaped cathode becomes short. Thus, the possibility of breaking the line-shaped cathode is minimized and reliability is greatly improved. Furthermore, since the arc shape of the line cathode is accurately formed, by shaping the back side surface of the electron beam take-out electrode accurately to maintain the gap against the line-shaped cathode uniform, the amount of electron beam take-out becomes uniform along the length of the line-shaped cathodes. Accordingly, due to the minimization of vibration and the above-mentioned uniformity of the amount of electron beam take-out, nonuniformity of brightness on the screen is greatly reduced and a picture with good brightness uniformity is obtainable.

The preferred embodiments of the present invention now will be described in detail with reference to FIG. 1 through FIG. 12.

Figure 2:
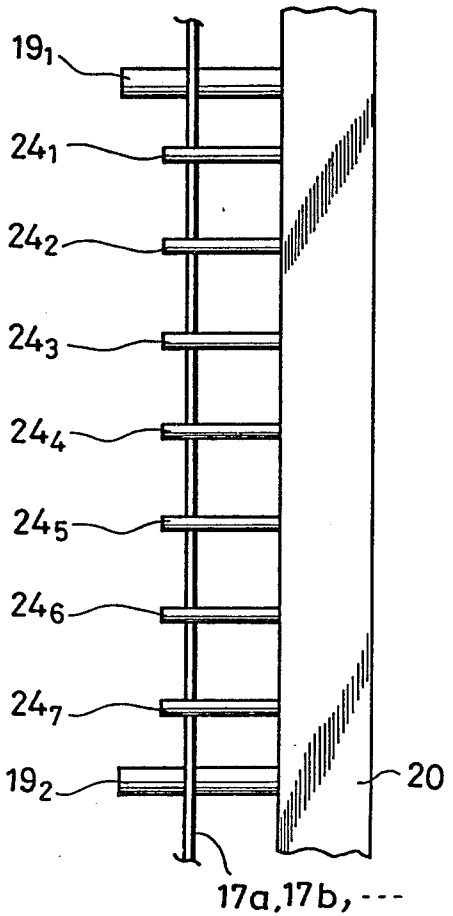
FIG. 2 is a rear view of the electron beam generation apparatus of FIG. 1.
Figure 1:
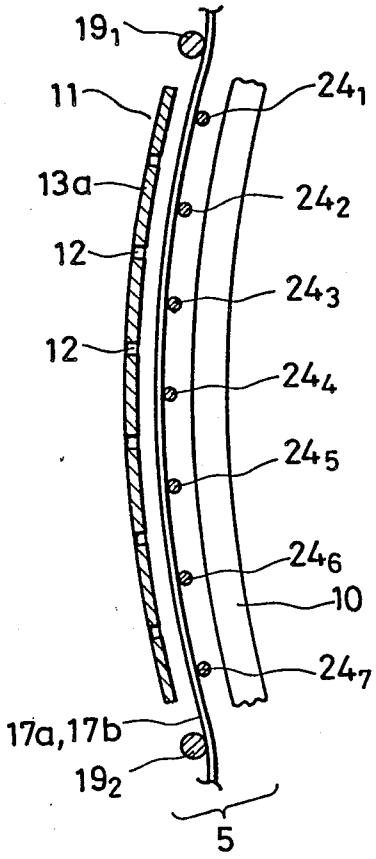
FIG. 1 is a sectional side view of an electron beam generation apparatus embodying the present invention.

FIG. 1 and FIG. 2 respectively show a sectional side view and a sectional rear view of an electron beam generation apparatus in accordance with the present invention. In the configuration of FIG. 1, a line-shaped cathode 17*a*, 17*b*, . . . is stretched with an appropriate tension between a pair of holders $19_1$ and $19_2$, which are provided with a predetermined distance therebetween. The line-shaped cathode is held by plural cathode position defining members $24_1$, $24_2$, $24_3$ . . . $24_7$, which are made of quartz rods and held on a holder block 20. In the known flat shape cathode ray tube, a back electrode (not shown) and an electron beam take-out electrode 13*a* having many electron passing apertures 12 are provided with a vertical parallel row of the line-shaped cathodes 17*a*, 17*b*, . . . therebetween. The vertical parallel row of the line-shaped cathodes 17*a*, 17*b*, . . . are provided in a direction perpendicular to the sheet of FIG. 1. The cathode position defining members $24_1$ . . . $24_7$ are disposed in a convex arc shape toward the face plate so as to protrude most at the center parts thereof and protrude less at both end parts thereof between the pair of cathode holders $19_1$ and $19_2$. The back electrode (not shown) and the electron beam take-out electrode 13*a* are also formed in a similar curved form so that the gap from the line-shaped cathodes 17*a*, 17*b*, . . . to the back electrode and the electron beam take-out electrode 13*a* is uniform along the length of the line-shaped cathodes 17*a*, 17*b*, . . . . When the back electrode, the electron beam take-out electrode 13*a* and the holder block 20 are assembled with their correct positional relationship, the cathode position defining members $24_1$, $24_2$, $24_3$ . . . are disposed uniformly between the pair of holders $19_1$ and $19_2$, and the line-shaped cathode is pushed forward by the cathode position defining members $24_1$ through $24_7$ to form a near arc shape which is pushed forward most at the center. By disposing the cathode position defining members $24_1$ through $24_7$ in an arc shape, all the cathode position defining members $24_1$ through $24_7$ firmly push the cathodes 17*a*, 17*b* . . . .

As a result of such a configuration, the points of touching of the cathode position defining members $24_1$ through $24_7$ to the line-shaped cathode 17*a*, 17*b*, . . . become nodes of the vibration of the line-shaped cathodes, 17*a*, 17*b*, . . . . Because the distance between the nodes are short, the vibration frequency of the cathodes become high and its amplitude of vibration becomes very small. Therefore, the undesirable vibration of the line-shaped cathode becomes negligibly small in comparison with the conventional line-shaped cathode. Furthermore, the vibration is attenuated in a very short time and there is almost no fear of short-circuiting of the cathode by excessive vibration and touching to other electrodes. And reliability is therefore much improved.

Furthermore, since the gap between the line-shaped cathode and the electron beam take-out electrode is uniform all along the length of the line-shaped cathodes 17*a*, 17*b*, . . . , the amount of electron beams taken out through the apertures 12 becomes uniform along the length of the line-shaped cathodes 17*a*, 17*b*, . . . , thereby making the brightness of phosphor screen uniform.

Figure 3:
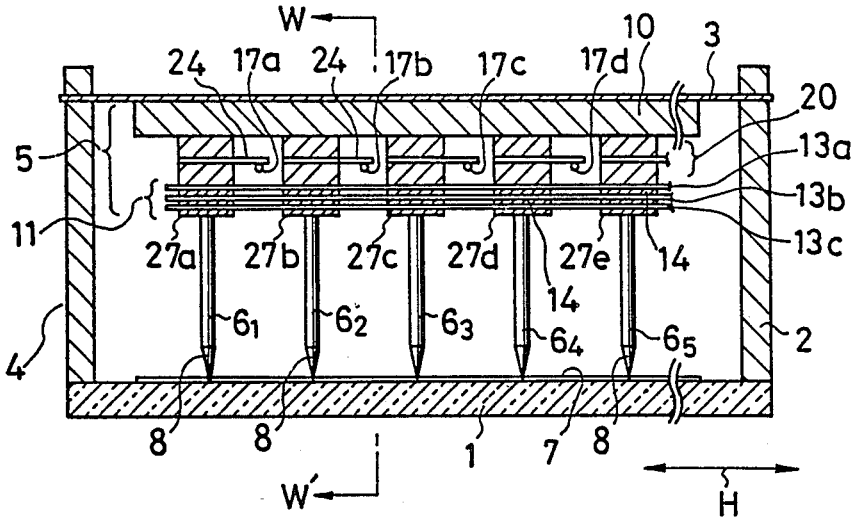
FIG. 3 is a sectional plan view showing a flat type cathode ray tube embodying the electron beam generation apparatus in accordance with the present invention.

FIG. 3 through FIG. 12 show a preferred embodiment of a flat type cathode ray tube wherein the electron beam generation apparatus of the present invention is used. In FIG. 3, the line-shaped cathodes 17*a*, 17*b*, 17*c*, 17*d* are stretched substantially in a vertical direction so as to form an arc shape by being pushed by cathode position defining members $23_1$, $23_2$, $23_3$, $23_4$ . . . $23_7$. Both ends of the line-shaped cathodes are held by a pair of springs 18*a*, 18*b*. A pair of cathode holders 19*a* and 19*b* are provided to touch the electron beam take-out electrode 11. Between the most rearward electrode 13*a* of the electron beam take-out electrode 11 and the back electrode 10, plural vibration prevention members 20 are provided.

Figure 5:
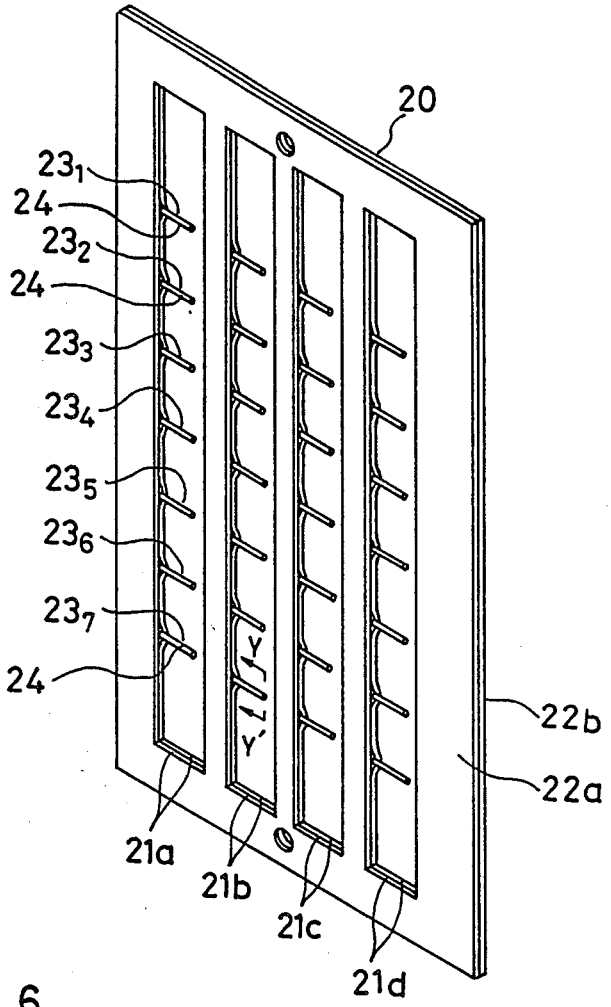
FIG. 5 is a perspective view showing the vibration prevention device 20 of the embodiment of FIG. 3.
Figure 6:
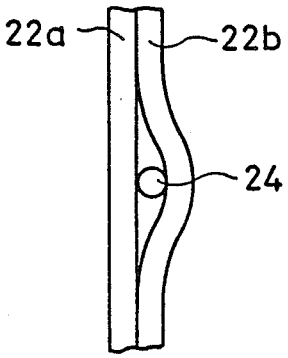
FIG. 6 is an enlarged partial sectional view of a part of the vibration prevention device 20 of FIG. 5.

As shown in FIG. 5, the vibration prevention member 20 is made by laminating a pair of insulation sheets 22*a* and 22*b* respectively having vertically oblong windows 21*a*, 21*b*, 21*c* and 21*d*, wherein a plurality of the cathode position defining rods 24 are held by inserting their base parts between the pair of holding sheets 22*a* and 22*b*. The enlarged sectional configuration of one part of the holding means of the cathode position defining rod 24 between the holding sheets 22*a* and 22*b* is shown in FIG. 6. The vibration prevention member 20 is insulated from the back electrode 10 by insertion of appropriate known insulation means therebetween.

Figure 7:
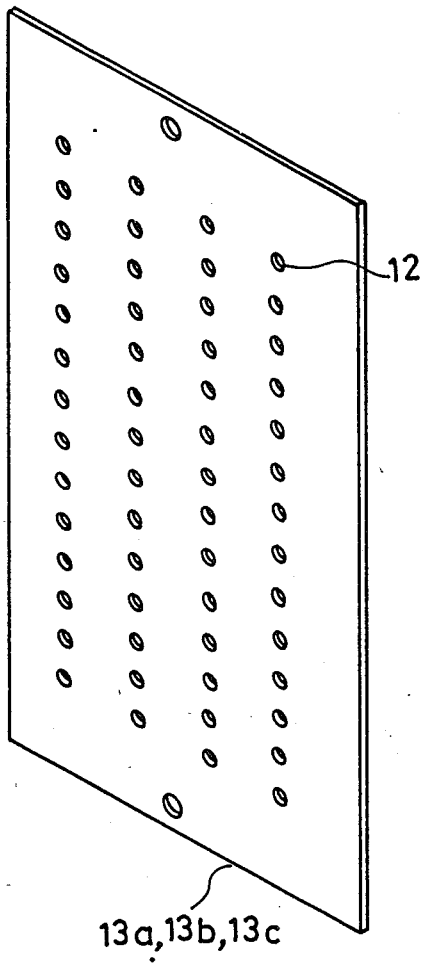
FIG. 7 is a perspective view of an electron beam take-out electrode 13*a*, 13*b*, 13*c* of the embodiment of FIG. 3.
Figure 8:
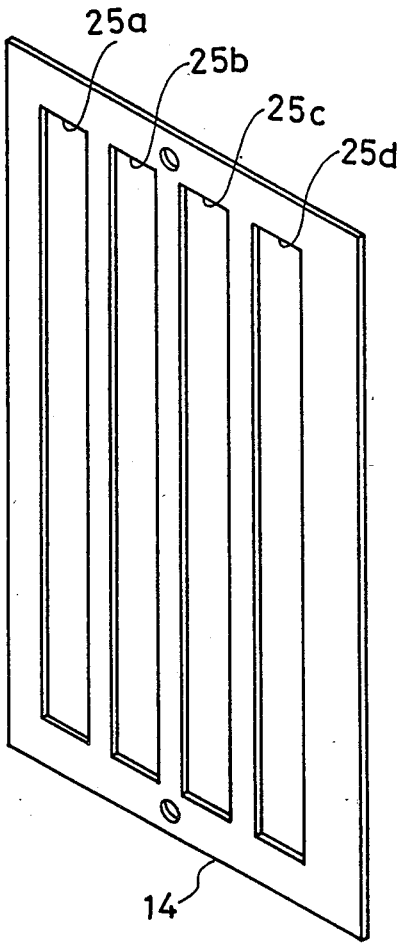
FIG. 8 is a perspective view of an insulative spacer 14 of the embodiment of FIG. 3.
Figure 9:
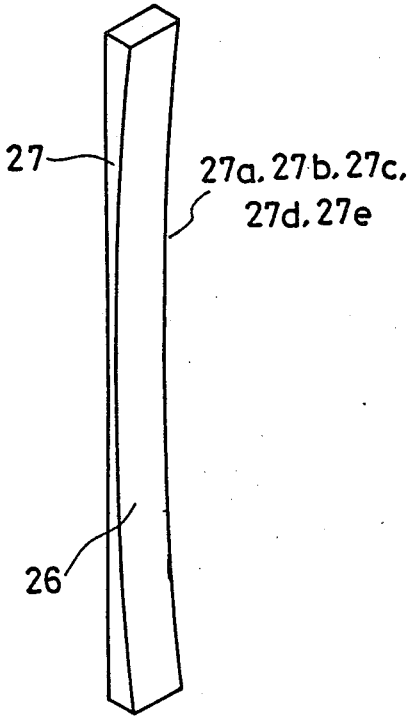
FIG. 9 is an enlarged perspective view of a holding member 27 shown in FIG. 4.

The electron beam take-out electrode 11 is constituted by laminating several (three, in this embodiment) metal sheet electrodes 13*a*, 13*b*, 13*c* as shown in FIG. 7, each having a number of electron beam passing apertures 12 with insulation spacers 14 (as shown in FIG. 8) therebetween. The insulation spacers 14 have vertically oblong windows 25*a*, 25*b*, 25*c*, 25*d*. On the front side face of the electron beam take-out electrodes 11, a group of horizontal deflection electrodes $6_1$, $6_2$, $6_3$, $6_4$, $6_5$ are fixed, and spacers 27*a*, 27*b*, 27*c*, 27*d*, 27*e*, having curved faces, as shown in FIG. 9, are disposed therebetween.

Figure 4:
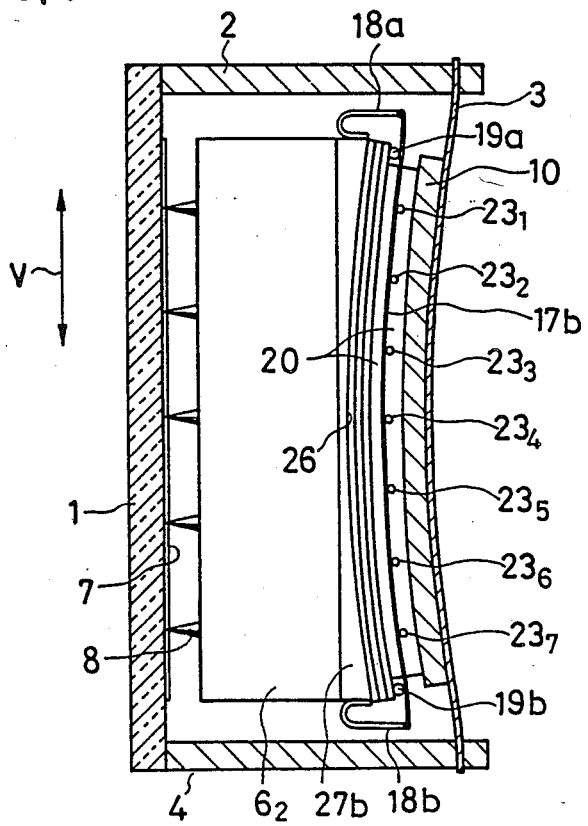
FIG. 4 is a sectional side view of the flat type cathode ray tube of FIG. 3 taken at the sectional plane W—W'.

Until the inside space of the casing 4 is evacuated, the vibration prevention member 20, the electrode metal sheets 13*a*, 13*b*, 13*c* and the insulation spacers 14 are, as shown in FIG. 5, FIG. 7 and FIG. 8, of flat shapes. However, when the inside space is evacuated after installation of these components in the casing 4, the back face 3 of the casing 4 is stressed toward the inside of the casing 4 by a great atmospheric pressure, and the back electrode 10 is bent inside. Therefore, as shown in FIG. 4 the back electrode 10 is bent toward the face plate 1 and hence the line-shaped cathode 19*a* is also bent, and further, the electron beam take-out electrodes 11 and the rear face 26 of the holding sheets 27 are also bent to the front side. The front side faces of the holding sheet 27 thus become flat and contact the rear ends of horizontal deflection electrodes $6_1$ . . . $6_5$. Therefore, atmospheric pressure on the back plate 3 is transmitted to the horizontal deflection electrodes $6_1$ . . . $6_5$ and to the inside wall of the face plate 1 through needle shaped supporting pins 8. Thus, the cathode position defining members $23_1$ through $23_7$ and hence the line-shaped cathodes 17*a*, 17*b* . . . are bent in an arc shape toward the front side.

In the flat type cathode ray tube configured as above, when the line-shaped cathode electrodes 17*a*, 17*b*, 17*c* . . . are heated and predetermined potentials are impressed on respective electrodes, electrons are emitted from the line-shaped cathode electrodes 17*a*, . . . and taken-out by the electron beam take-out electrodes 11. After deflection by the horizontal deflection electrodes $6_1$, $6_2$ . . . and by the vertical deflection electrodes (not shown), the electron beams strike the phosphor screen 7 on the inner wall of the face plate 1 and emit light.

Since the vibration prevention member 20 holds the cantilever shaped cathode position defining pins $23_1$, $23_2$ . . . , the rod shaped cathode position defining pins can easily be bent by tension of the line cathode. Therefore, even though there may be some positional error in fixing of the cathode position defining pins, the line-shaped cathodes 17*a*, 17*b*, . . . all contact the cathode position defining pins $23_1$, $23_2$ . . . , and hence, the intended vibration prevention is attainable. Furthermore, since the rods of the cathode position defining pins are fixed in a cantilever type configuration, there is no fear of breaking by thermal expansion during manufacturing of the vibration prevention member 20. When quartz glass rods are used as the material of the cathode position defining pins of small thermal conduction, heat of the line-shaped cathode electrodes 17*a*, 17*b* . . . are not lost therethrough, and an intended cathode temperature is attainable.

In modified examples, the vibration prevention member can be made in an integral configuration by using an insulative and heat resistive material. Furthermore, the vibration prevention member 20 can be made by using metal sheets 13*a*, 13*b*, 13*c* which are coated by heat resistive insulation film thereon.

Apart from the above-mentioned embodiment wherein the insulating supporting pins 8 are impressed on the inner all of the face plate 1 through the horizontal deflection electrodes $6_1$, $6_2$ . . . via holding members 27*a*, 27*b* . . . having arc shape curved surface 26 on one side thereof, the holding members 27*a*, 27*b* . . . may have an arc shaped concave face on both sides.

Figure 10:
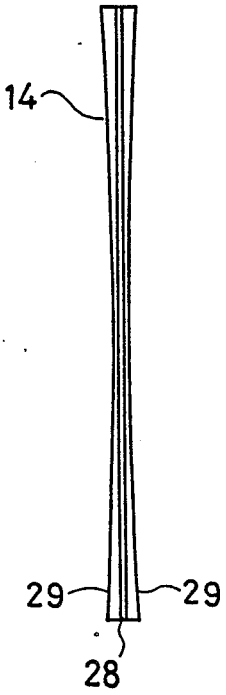
FIG. 10 is an enlarged side view of a modified embodiment of the insulation spacer 14.

Furthermore, another modified embodiment can be made such that the holding members 27*a*, 27*b* . . . are formed in a straight oblong rectangle of uniform thickness instead of having curved concave face(s), and a curved concave face as shown in FIG. 10 can be formed in shapes of insulation spacers 14 which are to be provided between the electron beam take-out electrodes 13*a*, 13*b*, 13*c*. Such insulative spacers 14 are made by sandwiching a core metal sheet 28 between a pair of insulative sheets 29 having a tapered thickness which is thinner at the center part and thicker at both end parts thereby to form curved surfaces. Such insulative material can be made by coating an insulative resin of such tapered thickness on both faces of the core metal sheet 28.

By disposing such spacers 14 having concave curved surfaces between the plural metal electrodes of the electron beam take-out electrodes 11, when the back plate 3 of the casing 4 is pressed into a concave shape to thereby form the back electrode 10 into a concave curved shape, the front side surface of the electrode metal sheet 13*a* which is facing the line-shaped cathode 17*a*, 17*b* . . . can be curved forwards so that the gap between the line-shaped cathode 17*a*, 17*b* . . . and the back side face of the electron beam take-out electrode 13*a* is made substantially uniform all along each line-shaped cathodes 17*a*, 17*b* . . . .

Figure 11:
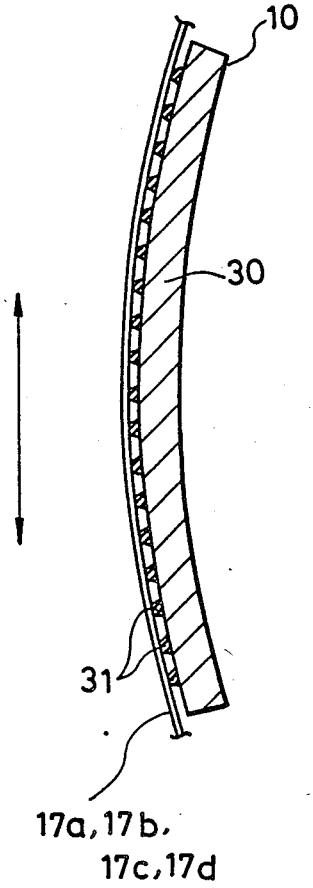
FIG. 11 and FIG. 12 are sectional side views of one embodiment of a combination of back electrode 30 and vibration prevention device 31 or 32.

Apart from the above-mentioned embodiments shown in FIG. 1 through FIG. 10 wherein the back electrode 10 and the vibration prevention member 20 are made as individual members, these members can be made integrally. In the embodiment of FIG. 11, for example, in the front side surface of a back electrode substrate 30 a number of protrusions 31 made of insulative material with small thermal conductivity may be provided in parallel horizontal lines, and the parallel horizontal protrusions 31 may be used as the cathode position defining member 17*a*, 17*b* . . . . As the material for the protrusions 31, solder glass can be used. Though conductive film of the back electrode 10 is not shown in these figures, the back electrode is formed by a known method on the surface of the back electrode substrate 30 at the position between two appropriate protrusions 31.

Figure 12:
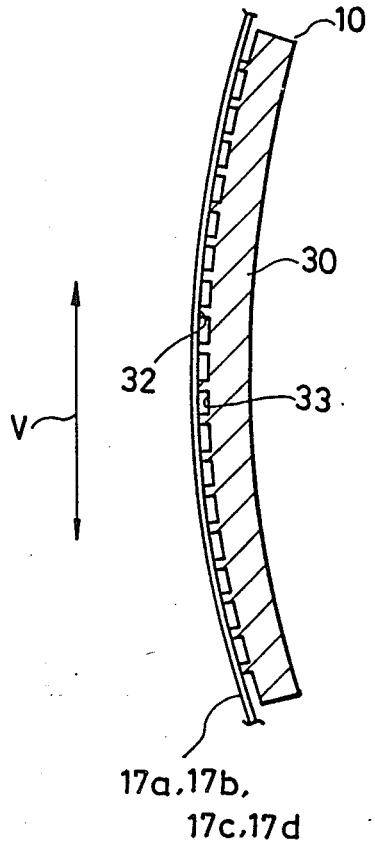
Figure 13:
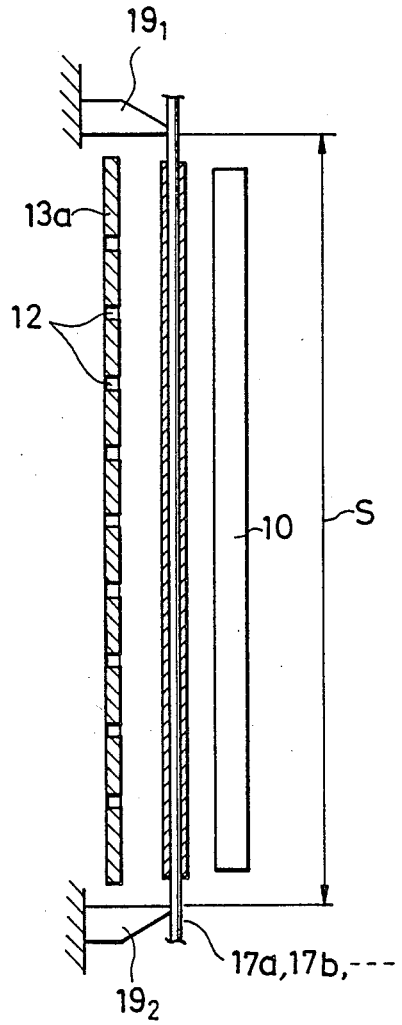
FIG.13 (PRIOR ART)
FIG. 13 is the sectional side view of one unit of the conventional electron beam generation apparatus.
Figure 14:
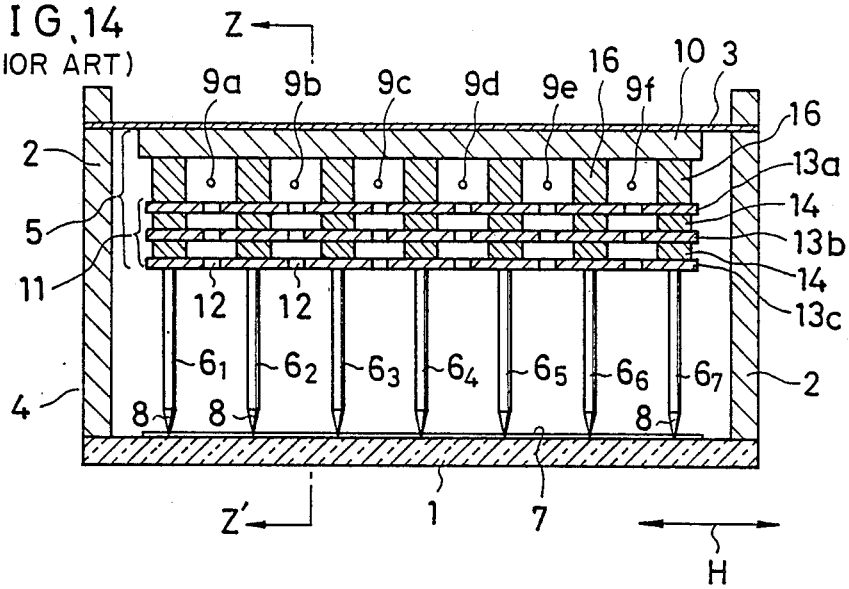
FIG. 14 (PRIOR ART)
FIG. 14 is a sectional view of the conventional flat type cathode ray tube using the electron beam generation apparatus shown in FIG. 13.
Figure 15:
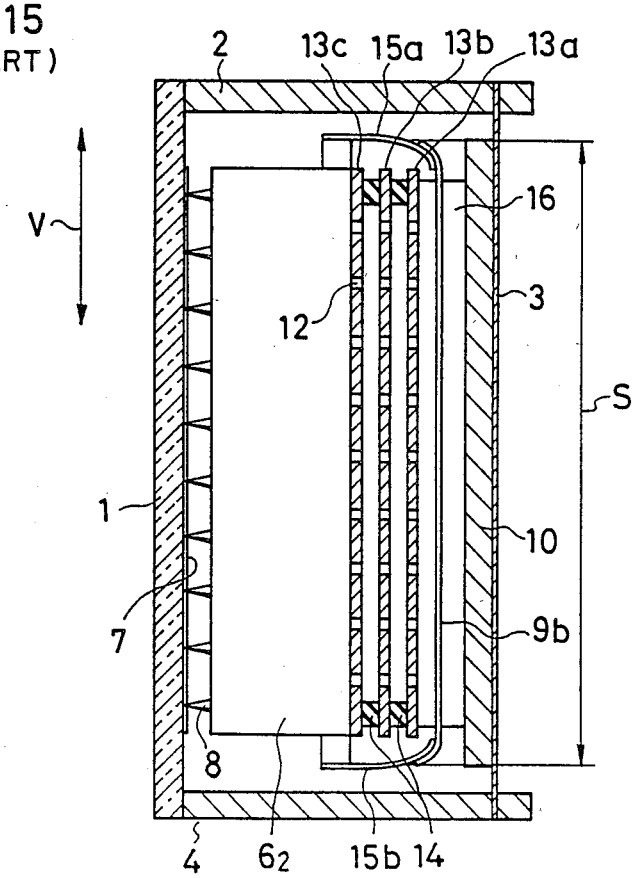
FIG. 15 (PRIOR ART)
FIG. 15 is the sectional side view of the conventional flat type cathode ray tube of FIG. 14 taken at sectional plane Z—Z'.
Figure 16:
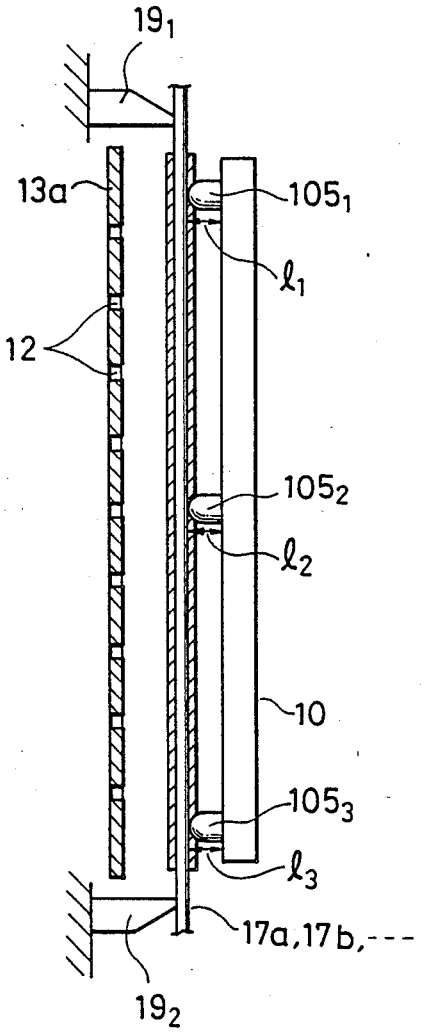
FIG. 16 (PRIOR ART)
FIG. 16 is the sectional side view of the modified conventional electron beam generation apparatus.

FIG. 12 shows another example of the back electrode substrate 30 with the cathode position defining members in an integral configuration. In this example of FIG. 12, the front side surface of the back electrode substrate 30 is etched so as to make parallel horizontal grooves 33, and hence to make parallel horizontal protrusions 32 relatively. The parallel horizontal protrusions 32 are used as the cathode position defining members 17*a*, 17*b* . . . . The back electrode is formed in a suitable place between the protrusions 32. As material of the back electrode substrate 30, a glass of high melting point or a ceramic may be used.

In the above-mentioned modified embodiments of FIG. 11 and FIG. 12, by integrally making the back electrode 10 and the cathode position defining members 31 or 32, the number of components can be reduced and the vertical pitch between the parallel horizontal cathode position defining member 17*a*, 17*b* . . . can be made very short thereby satisfactorily reducing the vibration of the line-shaped cathode.

Although the invention has been described in its preferred form with a certain degree of particularity, it is understood that the present disclosure of the preferred form may be changed in the details of construction and the combination and arrangement of parts may be resorted without departing from the spirit and the scope of the invention as hereinafter claimed.

What is claimed is:

1. An electron beam generation apparatus comprising:

at least one line cathode stretched between a pair of holding means for holding said at least one line cathode at both ends thereof;

an electron beam take-out electrode provided on a front side of said at least one line cathode with a predetermined gap therefrom;

a back electrode provided on a back side of said at least one line cathode with a predetermined gap therefrom; and plural cathode position defining means disposed at predetermined positions along said at least one line cathode for shaping it into a forward convex arc which protrudes at its center toward the electron beam take-out electrode.

2. An electron beam generation apparatus in accordance with claim 1, wherein said electron beam take-out electrode is formed in a forward convex arc shape so as to form a substantially uniform gap with said at least one line cathode.

3. An electron beam generation apparatus in accordance with claim 1, wherein said plural cathode position defining means are held by a holding sheet at oblong windows of said holding sheet; and said holding sheet and said electron beam take-out electrode are laminated and pressed onto forward convex arc shaped surfaces of holding members, thereby forming forward convex arc shapes of said at least one line cathode and said electron beam take-out electrode.

4. An electron beam generation apparatus in accordance with claim 1, wherein said plural cathode position defining means are made of a low thermal conduction substance.

5. An electron beam generation apparatus in accordance with claim 1, wherein said plural position defining means are cantilever pins held by a holding sheet at oblong windows of said holding sheet.

6. A flat cathode ray tube comprising:

at least one line cathode stretched between a pair of holding means for holding said at least one line cathode at both ends thereof;

an electron beam take-out electrode provided on a front side of said at least one line cathode with a predetermined gap therefrom;

a back electrode provided on a back side of said at least one line cathode with a predetermined gap therefrom;

plural cathode position defining means disposed at predetermined positions along said at least one line cathode for shaping it into a forward convex arc which protrudes at its center toward the electron beam take-out electrode, said plural cathode position defining means being held by a vibration prevention member at oblong windows of said vibration prevention member and pressed onto holding members having forward concave arc shaped surfaces, thereby to define forward convex arc shapes of said at least one line cathode and said electron beam take-out electrode; and a vacuum casing for enclosing the above-mentioned components therein, said vacuum casing having a face plate with a phosphor screen on the inside wall thereof and a back plate against which said back electrode is held, said back plate being bendable in a forward convex manner when said vacuum casing is in an evacuated state, thereby forming said back electrode and said plural cathode position defining means into a forward convex arc shape in said evacuated state.

7. A flat cathode ray tube in accordance with claim 6, wherein said holding members have forward concave surfaces on back sides thereof for receiving said electron beam take-out electrode, said vibration prevention member and said back electrode being bent in a forward convex arc shape by means of atmospheric pressure on the back plate when said vacuum casing is in said evacuated state.

8. A flat cathode ray tube in accordance with claim 6, wherein said electron beam take-out electrode comprises metal electrode sheets and bar shaped insulation spacers which are inserted between said metal electrode sheets, the electron beam take-out electrode having a tapered thickness distribution so as to be thinner at its central part and thicker at respective end parts thereof.

9. A flat cathode ray tube in accordance with claim 6, wherein said vibration prevention member comprises a plurality of rod shaped pins and a member which holds said rod shaped pins.

10. A flat cathode ray tube in accordance with claim 6, wherein said back electrode and said vibration prevention member are combined in an integral body.

11. A flat cathode ray tube in accordance with claim 10, wherein said vibration prevention member has protrusions, the surfaces of which are made of heat resistive insulative material.

* * * * *

UNITED STATES PATENT AND TRADEMARK OFFICE

CERTIFICATE OF CORRECTION

PATENT NO. : 4,887,000

DATED : December 12, 1989

INVENTOR(S) : YAMAZAKI, et al.

It is certified that error appears in the above-identified patent and that said Letters Patent is hereby corrected as shown below: Title page, item [73] should read as follows:

Assignee: Matsushita Electric Industrial Co., Ltd.,
Kadoma, Japan

Signed and Sealed this

Eighth Day of January, 1991

*Attest:*

*Attesting Officer*

HARRY F. MANBECK, JR.

*Commissioner of Patents and Trademarks*